United States Patent [19]

Kim

[11] 4,448,706

[45] May 15, 1984

[54] DEFOAMING DETERGENT ADDITIVES CONTAINING BLEACHED TALLOW ACID PHOSPHATES

[75] Inventor: Bongsub Kim, Grosse Ile, Mich.

[73] Assignee: BASF Wyandotte Corporation, Wyandotte, Mich.

[21] Appl. No.: 376,283

[22] Filed: May 10, 1982

[51] Int. Cl.[3] ..... C11D 17/00; C11D 1/78

[52] U.S. Cl. ..... 252/108; 252/99; 252/135; 252/174.16; 252/174.21; 252/321; 252/358; 260/963; 260/989

[58] Field of Search ..... 252/99, 135, 174.16, 252/174.21, 321, 358, 108; 260/963, 989

[56] References Cited

U.S. PATENT DOCUMENTS

| | | | |
|---|---|---|---|
| 3,314,891 | 4/1967 | Schmolka et al. | 252/174.21 X |
| 3,523,902 | 8/1970 | Schmolka | 252/137 |
| 3,595,968 | 7/1971 | Groves | 252/99 |
| 3,630,923 | 12/1971 | Simmons et al. | 252/99 |
| 4,070,298 | 1/1978 | Scardera et al. | 252/99 X |

*Primary Examiner*—John E. Kittle
*Assistant Examiner*—Mukund J. Shah
*Attorney, Agent, or Firm*—Joseph D. Michaels

[57] ABSTRACT

This invention relates to defoaming detergent additives especially suitable for use in automatic dishwashing machines. The defoaming detergent additives are mixtures of a certain nonionic surfactant and a bleached tallow acid phosphate ester.

5 Claims, No Drawings

DEFOAMING DETERGENT ADDITIVES CONTAINING BLEACHED TALLOW ACID PHOSPHATES

BACKGROUND OF THE INVENTION

1. Field of the Invention

This invention relates to defoaming detergent additives especially suitable for use in automatic dishwashing machines. The defoaming detergent additives are mixtures of a certain nonionic surfactant and a bleached tallow acid phosphate.

2. Description of the Prior Art

Preventing the formation of foam in automatic dishwashing machines is necessary in order for the machines to provide maximum cleaning efficiency. It is known that the formation of foam can be minimized by using dishwashing detergents containing defoaming additives. These additives are mixtures of low foaming nonionic surfactants and alkyl acid phosphates. See, for example, U.S. Pat. Nos. 3,314,891 and 4,070,298. It is also known that hydrogen peroxide or other bleaching agents may be combined with the phosphoric acid ester or with the mixture in order to bleach or lighten the color of the additive to make it more attractive. Although such teachings are known, there is still a need to improve the efficiency of automatic dishwashing machines by developing improved defoaming additives.

SUMMARY OF THE INVENTION

The subject invention relates to defoaming detergent additives comprising (a) a double heteric polyoxyalkylene polyol prepared by condensing a mixture of 90 weight percent propylene oxide and 10 weight percent ethylene oxide with trimethylolpropane so as to provide a hydrophobic base having a molecular weight of about 3200 and the condensing a mixture of 90 weight percent ethylene oxide and 10 weight percent propylene oxide with the hydrophobic base so as to provide a hydrophilic portion having a molecular weight of about 1280, and (b) a bleached tallow acid phosphate ester. These defoaming detergent additives are particularly useful in minimizing the foam generated during the automatic dishwashing machine cycle.

The subject compositions also represent an improvement over commercially available defoaming detergent additives. It could not be predicted that these compositions would be an improvement because experiments showed that mixtures containing a nonionic surfactant and bleached monostearyl acid phosphate had decreased defoaming powder. Moreover, experimentation showed that defoaming additives containing a nonionic surfactant and monostearyl acid phosphate were more effective at defoaming than additives containing a nonionic surfactant and cetyl acid phosphates. Consequently, it could not be predicted that a mixture containing a nonionic surfactant and a bleached tallow acid phosphate (which is mostly monostearyl acid phosphate) would be a better defoamer than either of the preceding combinations.

DESCRIPTION OF THE PREFERRED EMBODIMENT

The nonionic surfactant which is used in the subject invention is a double heteric conjugated polyoxyalkylene polyol prepared by condensing a mixture of 90 weight percent propylene oxide and 10 weight percent ethylene oxide with trimethylolpropane so as to provide a hydrophobic base having a molecular weight of about 3200 and then condensing a mixture of 90 weight percent ethylene oxide and 10 weight percent propylene oxide with the hydrophobic base so as to provide a hydrophilic portion having a molecular weight of about 1280.

The tallow acid phosphates which are used in the subject invention can be prepared by using conventional methods. These methods involve the reaction of a phosphating agent with tallow alcohol. In carrying out the reaction, it is preferable to provide a mole ratio of tallow alcohol to phosphating agent ranging from about 1:1 to about 6:1. Usually the phosphating agent is phosphoric pentoxide or a polyphosphoric acid such as 115 percent polyphosphoric acid. A mixture of compounds usually results. Reactions of polyphosphoric acid or phosphorus pentoxide and alcohols to prepare phosphoric acid esters is well established in the literature. No special procedures are required when using tallow alcohol.

The method for bleaching the tallow acid phosphates is well known in the art and is described in the foregoing references. Hydrogen peroxide or other suitable bleaching agents are combined with the tallow acid phosphates or mixture of tallow acid phosphates and nonionic surfactant in amounts such that from 1 to 10 percent by weight of bleaching agent is added relative to the weight of the tallow acid phosphates to be bleached. Preferably used as the bleaching agent is a 30 percent solution of hydrogen peroxide in water.

For purposes of this invention, the term "tallow alcohol" refers to a natural or synthetic mixture of stearyl and cetyl alcohols which contains at least 90 percent by weight of cetyl and stearyl alcohols. The weight ratio of stearyl to cetyl alcohol in the mixture may range from 1.05 to 1.3.

The additive compositions of this invention generally contain a weight ratio of nonionic surfactant to the phosphoric acid ester of from about 1:1 to about 99:1, preferably from about 3:1 to about 90:1, and more preferably about 9:1 to about 49:1. The blending of the ingredients in the aforementioned proportions can be readily done in a conventional mixing apparatus at temperatures of from about room temperature to about 100° C., depending upon the melting point of the materials used. When desirable, the blended mixture may be ground or flaked to obtain the blended ingredients in a suitable size. The composition is then added to an automatic dishwashing detergent formulation in order to reduce foaming during the use thereof. It is also possible to separately add the ingredients of the additive compositions of the invention, in proportions set forth, to the automatic dishwashing detergents to accomplish defoaming.

The automatic dishwashing detergents that can be combined with the present additive composition include a wide variety of commercially available detergent formulations. These may consist of inorganic salts, such as phosphates and silicates (referred to as detergent "builders"). The detergents may also contain a chlorinated compound such as potassium dichloroisocyanate, or chlorinated trisodium phosphate. Thus, it is readily apparent that the additive composition of the invention can be employed in any dishwashing detergent formulation as disclosed or used in the prior art.

The amount of the additive in the total dishwashing detergent may be any amount which is effective to reduce foaming. Illustrative amounts generally range from about 0.2 to about 20 percent by weight of the total automatic dishwashing detergent, preferably 0.5 to about 10 weight percent, and most preferably from about 1 to about 4 weight percent.

While the additive composition of the invention is especially suited for use with automatic dishwasher detergents, it may also be employed with other types of detergents where the problem of excessive foaming occurs.

The examples which follow will provide detailed illustrations of the subject invention. The parts referred to in the examples are by weight unless otherwise stated, and the temperatures are given in degrees Centigrade unless otherwise stated.

The following abbreviations are utilized in the examples:

| | |
|---|---|
| NS | a double heteric polyoxyalkylene polyol prepared by condensing a mixture of 90 percent propylene oxide and 10 weight percent ethylene oxide with trimethylolpropane so as to provide a hydrophobic base having a molecular weight of about 3200 and then condensing a mixture of 90 weight percent ethylene oxide and 10 weight percent propylene oxide with the hydrophobic base so as to provide a hydrophilic portion having a molecular weight of about 1280. |
| MSAP | monostearyl acid phosphate |
| BMSAP | bleached MSAP |
| MCAP | monocetyl acid phosphate |
| BMCAP | bleached MCAP |
| MTAP | monotallow acid phosphate |
| BMTAP | bleached MTAP |
| PPA | polyphosphoric acid (115 percent). |
| CA | cetyl alcohol (95 percent). |
| SA | stearyl alcohol (95 percent). |
| TA | a natural occurring tallow alcohol as a mixture of $C_{18}$ (65 percent), $C_{16}$ (28 percent), $C_{12}$ (0.1 percent), $C_{14}$ (3.5 percent), $C_{15}$ (0.3 percent), $C_{17}$ (1.4 percent), and $C_{20}$ (0.8 percent). |

EXAMPLES

Several alkyl acid phosphates were prepared by adding an alcohol to a 3-necked flask equipped with a stirrer and thermometer, under a nitrogen blanket, and heating to 60° C. until molten. Then, 115 percent PPA was added, and the reaction mixture was stirred for approximately two and one-half hours at 90° C. The reaction mixture was then cooled to approximately 80° C. and hydrogen peroxide (30 percent in water) was added over a period of 30 minutes at 85° C. Table I which follows gives the specific ingredients and the amounts used to prepare the alkyl acid phosphates which were employed to prepare the compositions of the subject invention and compositions which were used for comparative purposes.

TABLE I

| Example | Alcohol | Alcohol parts (mole) | 115% PPA parts (mole) | 30% $H_2O_2$ parts | 30% $H_2O_2$ percent by weight based upon sample) |
|---|---|---|---|---|---|
| 1 | CA | 125 (0.50) | 57 (0.19) | — | — |
| 2 | CA | 170 (0.67) | 79 (0.27) | — | — |
| 3 | CA | 170 (0.67) | 79 (0.27) | 5.0 | 2.0 |
| 4 | SA | 175 (0.65) | 76 (0.26) | — | — |
| 5 | SA | 175 (0.65) | 76 (0.26) | 10.0 | 4.0 |
| 6 | TA | 250 (0.94) | 97 (0.33) | — | — |
| 7 | TA | 250 (0.94) | 97 (0.33) | 13.9 | 4.0 |
| 8 | TA | 250 (0.94) | 109 (0.37) | — | — |
| 9 | TA | 250 (0.94) | 109 (0.37) | 14.4 | 4.0 |
| 10 | TA | 173 (0.64) | 75 (0.25) | — | — |
| 11 | TA | 173 (0.64) | 75 (0.25) | 9.9 | 4.0 |

Detergent defoaming additives were then prepared by adding 3 percent by weight, based on the weight of the total composition, of the alkyl acid phosphates to NS. The detergent defoaming additives were then tested in a dishwashing detergent formulation in accordance with a procedure described by I. R. Schmolka and T. M. Kaneko, "Protein Soil Defoaming and Machine Dishwashers", *Journal of the American Oil Chemists Society,* Vol. 45, No. 8, pages 563–566 (1968). The dishwashing detergent formulations were utilized in a Hobart Kitchen Aid dishwasher and the foam characteristics were measured by observing the rate of rotation of the perforated spray arm during the washing cycle in which raw egg soil and detergent were present in definitive quantities. The rate of the rotation of the arm is inversely proportional to the amount of foam present. The procedure followed was to turn on the dishwasher and fill it with 11 to 12 liters of water. The dishwasher was opened, water temperature noted, and 15 grams of raw egg soil and 20 grams of formulated detergent were added to the water. The dishwasher was restarted and the rotation rate of the spray arm was measured by means of a magnetic counter. The first minute was considered mixing time and the rotation of the spray arm is noted after this mixing time for a total of 5 minutes at 1 minute intervals. The revolutions per minute for the fourth minute were selected as the standard for comparison. The dishwasher was turned off and the water temperature noted at the end of the test.

Table II which follows illustrates the effectiveness of MSAP, MTAP, and MCAP in combination with NS as defoaming detergent additive. The results show that the additive containing MSAP is more effective than the one containing MTAP which is more effective than the one containing MCAP.

TABLE II

| | MSAP of Example 4 | MTAP of Example 10 | MCAP of Example 1 |
|---|---|---|---|
| 80° F. | | | |
| No Soil | 41 | 36 | 29 |
| Milk Soil | 24 | 28 | 25 |
| Egg Soil | 31 | 32 | 28 |
| 100° F. | | | |
| No Soil | 46 | 47 | 43 |
| Milk Soil | 38 | 36 | 35 |
| Egg Soil | 47 | 44 | 39 |
| 120° F. | | | |
| No Soil | 50 | 50 | 50 |
| Milk Soil | 43 | 44 | 43 |
| Egg Soil | 47 | 45 | 47 |
| 140° F. | | | |
| No Soil | 52 | 52 | 52 |
| Milk Soil | 48 | 48 | 49 |
| Egg Soil | 51 | 51 | 49 |
| Total | 518 | 513 | 489 |

Table III which follows illustrates the effect of bleaching MSAP and MCAP. The results illustrate that the defoaming additive containing BMSAP is less effective as a defoamer while the defoaming detergent additive composition containing BMCAP is more effective as a defoamer.

TABLE III

| | MSAP of Example 4 | BMSAP of Example 5 | MCAP of Example 2 | BMCAP of Example 3 |
|---|---|---|---|---|
| Alcohol/PPA | | | | |
| At 80° F. | | | | |
| No Soil | 41 | 33 | 33 | 37 |
| Milk Soil | 24 | 24 | 26 | 27 |
| Egg Soil | 31 | 33 | 30 | 32 |
| At 100° F. | | | | |
| No Soil | 46 | 44 | 45 | 48 |
| Milk Soil | 38 | 34 | 37 | 35 |
| Egg Soil | 47 | 41 | 33 | 42 |
| At 120° F. | | | | |
| No Soil | 50 | 49 | 46 | 50 |
| Milk Soil | 43 | 44 | 42 | 46 |
| Egg Soil | 47 | 46 | 45 | 43 |
| At 140° F. | | | | |
| No Soil | 52 | 53 | 52 | 53 |
| Milk Soil | 48 | 48 | 51 | 50 |
| Egg Soil | 51 | 49 | 49 | 52 |
| Total RPM | 518 | 498 | 489 | 515 |

Table IV which follows illustrates the effect of bleaching MTAP. The table shows that the defoaming additive containing BTAP is more effective as a defoamer. This is unexpected in view of the data in Table III which shows that BMSAP is less effective than MSAP since MTAP is prepared from a mixture of TA and SA wherein the weight ratio of SA to CA is almost 3:1.

TABLE IV

| | MTAP of Example 6 | BMTAP of Example 7 | MTAP of Example 8 | BMTAP of Example 9 |
|---|---|---|---|---|
| 80° F. | | | | |
| No Soil | 43 | 44 | 47 | 41 |
| Milk Soil | 25 | 30 | 31 | 26 |
| Egg Soil | 34 | 32 | 34 | 31 |
| 100° F. | | | | |
| No Soil | 54 | 53 | 56 | 63 |
| Milk Soil | 43 | 41 | 45 | 49 |
| Egg Soil | 45 | 42 | 40 | 47 |
| 120° F. | | | | |
| No Soil | 56 | 60 | 54 | 56 |
| Milk Soil | 44 | 49 | 46 | 41 |
| Egg Soil | 42 | 46 | 48 | 40 |
| 140° F. | | | | |
| No Soil | 44 | 56 | 52 | 56 |
| Milk Soil | 43 | 48 | 46 | 53 |
| Egg Soil | 41 | 52 | 47 | 53 |
| Total RPM | 514 | 553 | 546 | 556 |

Table V which follows compares a defoaming additive containing BMTAP with one containing MSAP and one containing BMSAP with respect to their defoaming power. The table shows that the additive containing BMTAP is more effective as a dishwashing detergent defoamer than the additive containing MSAP or BMSAP.

TABLE V

| | MSAP of Example 4 | BMSAP of Example 5 | BMTAP of Example 11 |
|---|---|---|---|
| 80° F. | | | |
| No Soil | 41 | 33 | 70 |
| Milk Soil | 24 | 24 | 28 |
| Egg Soil | 31 | 33 | 37 |
| 100° F. | | | |
| No Soil | 46 | 44 | 48 |
| Milk Soil | 38 | 34 | 38 |
| Egg Soil | 47 | 41 | 46 |
| 120° F. | | | |
| No Soil | 50 | 49 | 49 |
| Milk Soil | 43 | 44 | 43 |
| Egg Soil | 47 | 46 | 48 |
| 140° F. | | | |
| No Soil | 52 | 53 | 52 |
| Egg Soil | 51 | 49 | 52 |
| Total | 518 | 498 | 527 |

The embodiments of the invention in which an exclusive privilege or property is claimed are defined as follows:

1. A dishwashing detergent additive composition comprising (a) a double heteric polyoxyalkylene polyol prepared by condensing a mixture of 90 percent propylene oxide and 10 percent ethylene oxide with trimethylolpropane so as to provide a hydrophobic base having a molecular weight of about 3200 and then condensing a mixture of 90 weight percent ethylene oxide and 10 weight percent propylene oxide with the hydrophobic base so as to provide a hydrophilic portion having a molecular weight of about 1280, and (b) a bleached mono tallow alcohol phosphate ester, wherein the weight ratio of (a) to (b) is from 1:1 to 99:1.

2. The composition of claim 1 wherein the weight ratio of (a) to (b) is from 9:1 to about 49:1.

3. The composition of claim 1 wherein the tallow acid phosphates are prepared by reacting from 2.4 to 2.9 moles of tallow alcohol per mole of polyphosphoric acid.

4. The composition of claim 3 wherein the tallow alcohol is a natural tallow alcohol.

5. A dishwashing detergent formulation comprising from 0.2 to 20 percent by weight of the additive of claim 1, said weight being based upon the total weight of the detergent.

* * * * *